United States Patent [19]

Fugere et al.

[11] 4,035,860

[45] July 19, 1977

[54] PROTECTIVE GAITER

[76] Inventors: Albert Lee Fugere, 4901 - 17th Ave. S., Seattle, Wash. 98108; Michael Joseph Kelly, 808 NE. 82nd, Seattle, Wash. 98115

[21] Appl. No.: 703,903

[22] Filed: July 9, 1976

Related U.S. Application Data

[60] Division of Ser. No. 552,551, Feb. 24, 1975, which is a continuation-in-part of Ser. No. 461,156, April 15, 1974, abandoned.

[51] Int. Cl.[2] ..... A43D 9/00

[52] U.S. Cl. ..... 12/142 W

[58] Field of Search ..... 12/142 R, 142 W; 36/1.5, 2; 2/22

[56] References Cited

U.S. PATENT DOCUMENTS

| | | | |
|---|---|---|---|
| 1,274,837 | 8/1918 | Aschiem | 12/142 W |
| 1,672,132 | 6/1928 | Morrill | 12/142 W |
| 2,438,308 | 3/1948 | Wheaton | 36/2 R |

*Primary Examiner*—Patrick D. Lawson

[57] ABSTRACT

A protective gaiter which extends from a wearer's instep to just below his knee. A portion of the gaiter forms a completely closed pocket which contains an energy-absorbing pad. The pocket and the pad are both elongated, covering substantially the length of the gaiter, and include a concavely shaped bottom edge which lets the gaiter be conveniently positioned around the wearer's instep so that it fits over and protects the wearer's shinbones, as well as covering many of the major bones and muscles of the wearer's leg.

In the manufacture of the protective gaiter, identical front and liner panels and a somewhat smaller, interposed back panel are aligned and sewn together along one longitudinal edge. An elastic strip, which forms the stirrup of the protective gaiter, is next secured between opposing ends of the bottom edges of the front and liner panels, which bottom edges are then sewn together. The other longitudinal edges of the front, liner and back panels are then aligned and sewn together. An energy-absorbing protective pad is then inserted into the pocket defined by the front and liner panels, and the upper edges thereof thereafter sewn together. A collar secured to the upper edge of the gaiter completes the article.

7 Claims, 30 Drawing Figures

Fig. 5a.
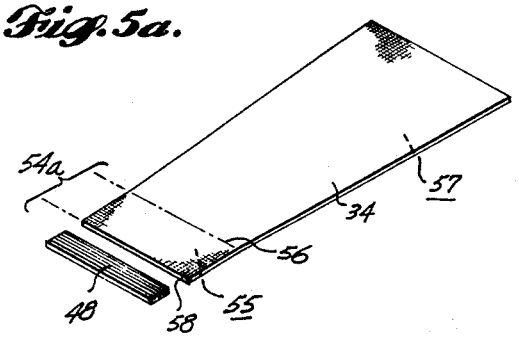
Fig. 5b.
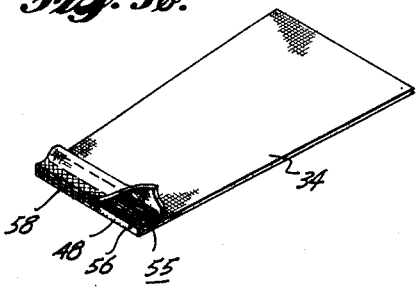
Fig. 6.
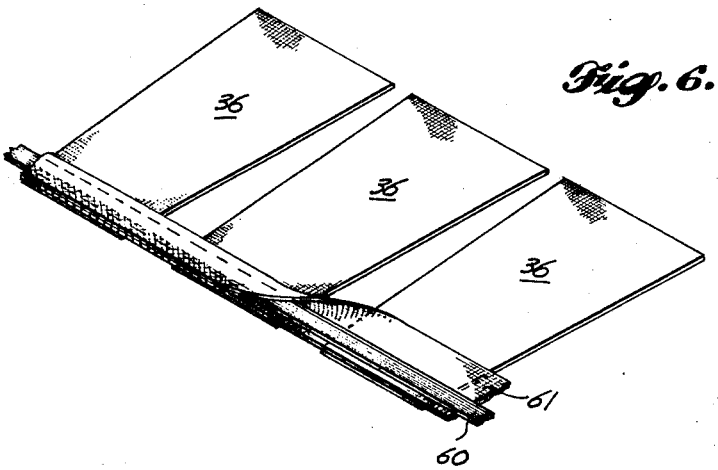
Fig. 7a.
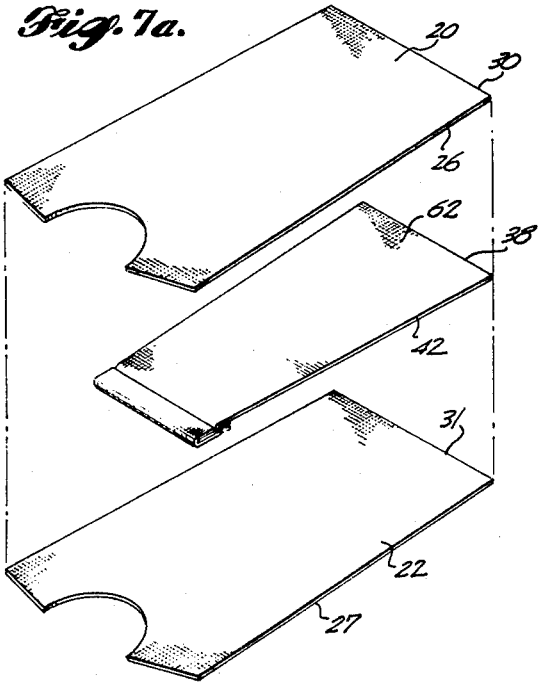
Fig. 7b.
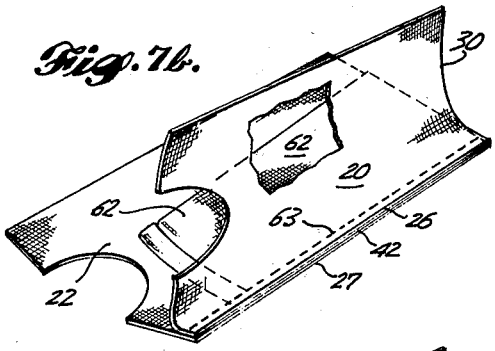
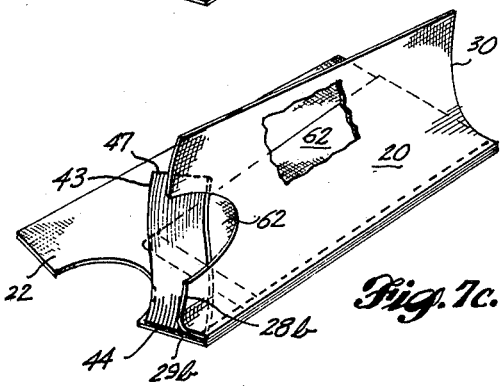
Fig. 7c.

Fig. 7d.
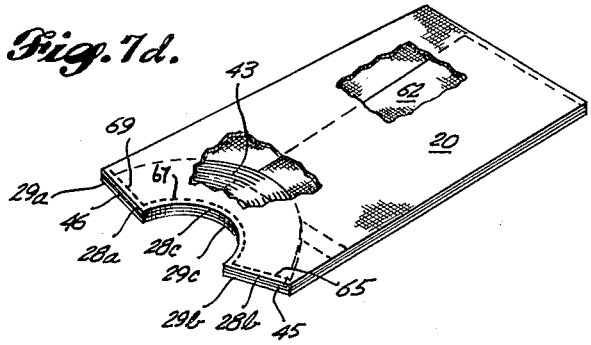
Fig. 7e.
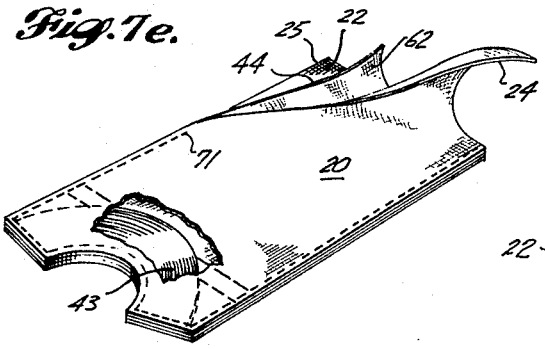
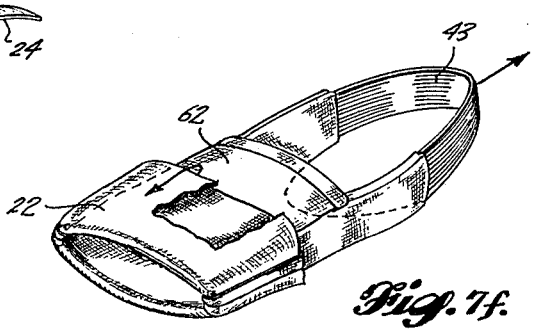
Fig. 7f.
Fig. 7g.
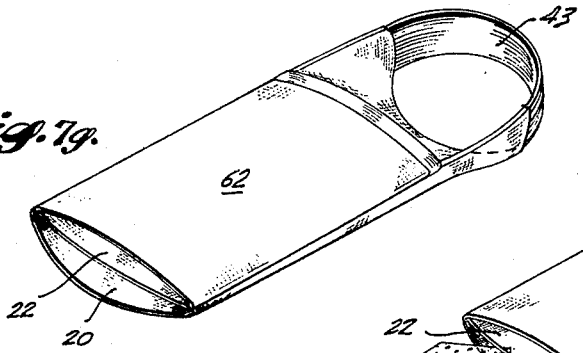
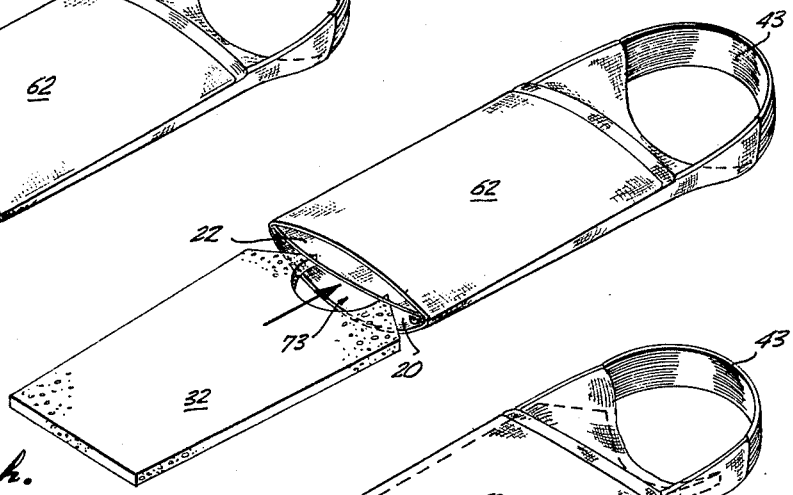
Fig. 7h.
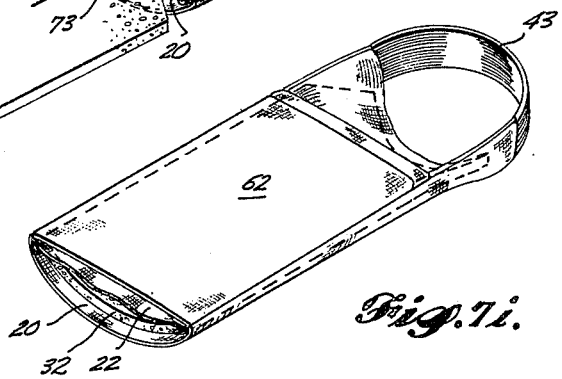
Fig. 7i.

Fig. 8a.
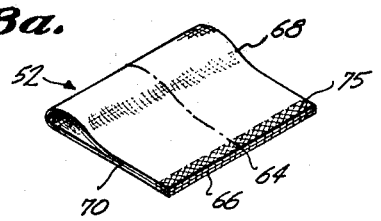
Fig. 8b.
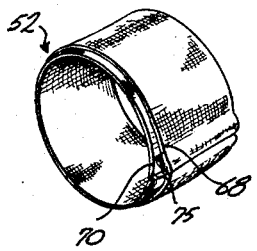
Fig. 9a.
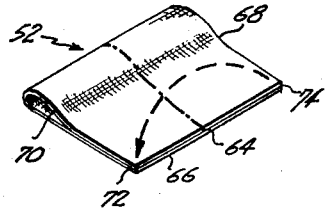
Fig. 9b.
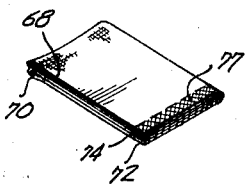
Fig. 9c.
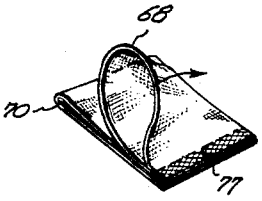
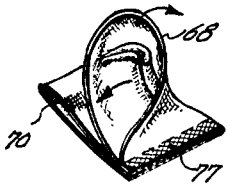
Fig. 9d.
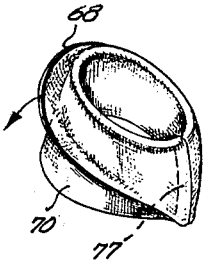
Fig. 9e.
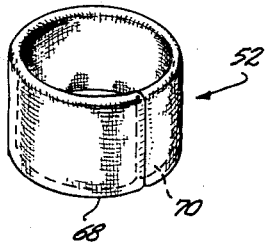
Fig. 9f.

PROTECTIVE GAITER

BACKGROUND OF THE INVENTION

This is a divisional of application Ser. No. 552,551, filed Feb. 24, 1975, which is a continuation-in-part of Ser. No. 461,156 filed Apr. 15, 1974, now abandoned.

This invention relates generally to the art of protective supporting equipment, and in particular is concerned with protective gaiters useful in protecting the limbs of a participant in contact sports such as soccer and hockey.

There are several types of energy-absorbing leg or arm guards for athletes known in the art. However, almost all of these devices have been designed exclusively for the major American sports, such as football and baseball. The available leg guard devices are thus typically unsuitable for other contact sports, notably soccer. For that reason, leg guards currently used by soccer players have several undesirable features, for instance the guards are typically secured to the wearer's legs by means of straps or by insertion of the guard element between the wearer's leg and his stocking. The insertable guard element is typically taped to the player's leg to maintain its position. Both this arrangement and the strap configuration have several disadvantages, however, particularly in that the wearer is required to constantly adjust and tighten his leg guards. This necessity of adjustment distracts the wearer, thereby reducing his concentration and attention, and hence, his skill, at the particular game he is playing.

The present invention combines a stocking or gaiter, which is a common part of an athlete's uniform, with an energy-absorbing protective pad, thereby eliminating the necessity of straps or tape. The combination of protective pad and gaiter provides an inexpensive, simple, and reliable means for protecting the shins, muscles and bones of the lower leg and ankle of the wearer. Preferably, the gaiter itself is made from stretchable nylon, sufficiently pliable to fit the curvature of the wearer's leg from his ankle to his knee, without being unduly rigid. The stretchable nylon performs two functions. It is a integral part of the uniform of the athlete-wearer, e.g. soccer player, and will typically be in a corresponding color with the rest of the uniform, and it secures the protective pad and maintains it in proper position relative to the lower leg and ankle during play. The stretchable nylon and the energy-absorbing pad, which is preferably a closed-cell, foam-like material, are conveniently washable and thus may be washed or cleaned with the other parts of the athletic uniform.

Other objects and advantages of the invention will become apparent during the course of the following description.

SUMMARY OF THE INVENTION

Concerning the article, the present invention comprises a gaiter which has defined therein a completely enclosed pocket, said pocket extending, when the gaiter is in place on a wearer's leg, substantially from the instep of the wearer to his knee, and also extending around the wearer's leg at least one-third of the circumference thereof, with the pocket having in outline an upper edge, a lower edge and two substantially parallel longitudinal edges therebetween, with the lower edge being concavely shaped to conform to the wearer's instep. Receivable in the pocket is a protective pad which has an outline substantially similar to the outline of the pocket, including a concavely shaped lower end which permits the pad to substantially fit around the instep of the wearer and over his shinbones when the article is in place on the wearer.

Concerning the manufacture of the article, the gaiter should be first understood to include first and second substantially identical fabric sections, with the first and second fabric sections having in outline upper and lower edges and two longitudinal edges extending therebetween, with the lower edge of the first and second fabric sections having first and second straight edge portions and a concavely shaped intermediate edge portion. The gaiter further includes a third fabric section having in outline upper and lower edges and two longitudinal edges extending therebetween, an energy-absorbing pad, and an elastic strap having two ends. In manufacturing the gaiter, the first, second and third fabric sections are first aligned such that their respective upper edges and one of their respective longitudinal edges are adjacent, said first, second and third fabric sections being secured together along a line adjacent said first longitudinal edges of each of said sections. The next step includes generally securing together the first and second fabric sections along a line adjacent the lower edges thereof, including securing one end of the elastic strip between adjacent first straight edge portions of said first and second fabric sections and securing the other end of said elastic strip between adjacent second straight edge portions of said first and second fabric sections. The other longitudinal edges of the first, second and third fabric sections are then aligned, and are secured along an adjacent line, with said first and second fabric sections now forming a pocket. The protective pad is then inserted into the pocket, and the first and second fabric sections are then secured together along a line adjacent the upper edges thereof, thereby completely enclosing said protective pad between said first and second fabric sections.

DESCRIPTION OF THE DRAWINGS

FIG. 5*a* is an isometric view showing the first step in an alternative method of securing an elastic back strap to the back panel, showing the relative sizes of the parts.

FIG. 5*b* is an isometric view showing the second step of the method of FIG. 5*a*, in which the back strap is covered by a folded portion of the back panel adjacent its lower edge.

FIG. 6 is an isometric view showing the method of manufacturing more than one back panel/back strap using the method of FIGS. 4a–4c but with a single strip of elastic back strap material cover used with several back panels.

FIG. 7a is an isometric view showing a preliminary step in the method of the present invention, illustrating the vertical alignment and relative positions of the front panel, back panel and liner panel prior to the first sewing step in the method of manufacturing the protective gaiter.

FIG. 7b is an isometric view showing the step in such a method of securing the back panel, liner panel and front panel together along aligned longitudinal edges thereof.

FIG. 7c is an isometric view showing the step in such a method of attaching one end of the elastic foot strap to the combination of back panel, front panel and liner panel.

FIG. 7d is an isometric view showing the step in such a method of attaching the other end of the elastic foot strap to the combination of back panel, front panel, liner panel, forming the stirrup, and the step of securing together the lower edges of the front panel and liner panel.

FIG. 7e is an isometric view showing the step in such a method of securing together of the other longitudinal edges of the back panel, front panel and liner panel.

FIG. 7f is an isometric view showing the step in such a method of pulling the article of FIG. 7e inside out.

FIG. 7g is an isometric view showing the protective gaiter rightside out.

FIG. 7h is an isometric view showing the step in such a method of inserting the protective pad into the pocket formed by the now-adjacent front and liner panels.

FIG. 7i is an isometric view showing the combination of gaiter and protective pad after completion of the step of FIG. 7h.

FIG. 8a is an isometric view showing the first step in a first alternative method of manufacturing the collar for the protective gaiter, in which the opposite ends of the collar panel are sewn together.

FIG. 8b is an isometric view showing the second step of the method of FIG. 8a, in which the sewn collar is folded longitudinally upon itself.

FIG. 9a is an isometric view showing the initial step in a second alternative method of manufacturing the collar for the protective gaiter, in which the collar panel is folded laterally back upon itself such that its respective ends terminate in a common plane.

FIG. 9b is an isometric view showing the step of the method of FIG. 9a, in which the once-folded collar of FIG. 9a is folded longitudinally and sewn along the folded adjacent end edges.

FIG. 9c is an isometric view showing the step of the method of FIGS. 9a and 9b, in which a portion of one longitudinal edge is opened in the shape of a loop.

FIGS. 9d and 9e are isometric views showing the step of the method of FIGS. 9a through 9c, in which the loop is folded over the remainder of the folded collar, reversing the sewn end edges to the inside of the collar.

FIG. 9f is an isometric view showing the finished collar from the method of FIGS. 9a through 9e.

DESCRIPTION OF THE PREFERRED EMBODIMENT

Figure 2:
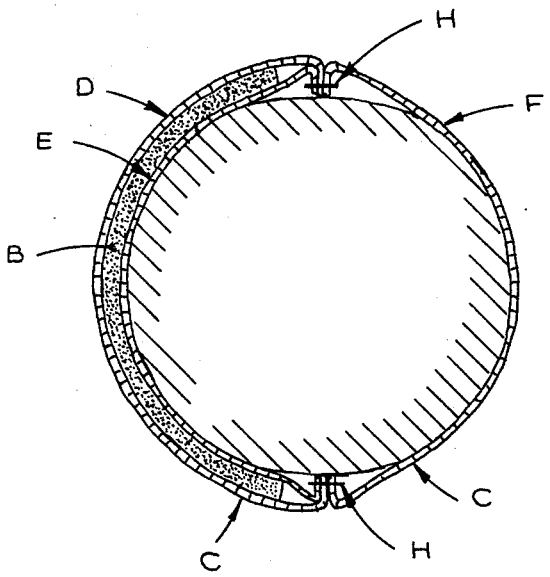
FIG. 2 is a cross-sectional view of the combination shown in FIG. 1, taken along line A—A of FIG. 1.
Figure 1:
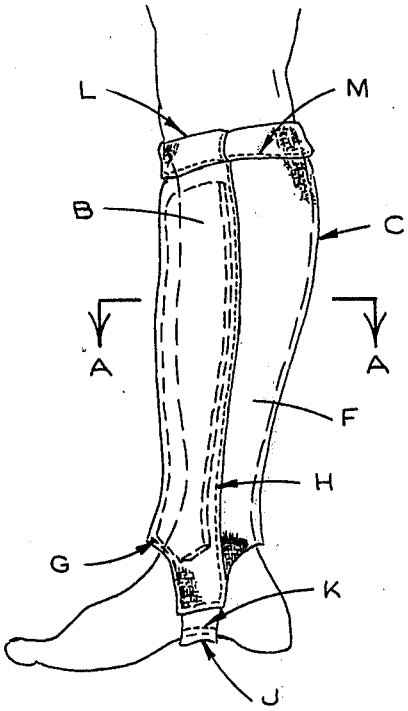
FIG. 1 is a side elevation view of the combination of gaiter and protective pad in place on a wearer's leg.

In FIGS. 1 and 2, wherein, for the purpose of illustration, is shown a preferred embodiment of the invention, the letter B designates a closed cell, polyvinyl chloride, energy-absorbing material. This energy-absorbing material is utilized as a protective leg and shin guard and is shaped so as to cover certain muscles and bones of the lower leg of a wearer, namely, the tibiales anterior and extensor hollucis longus muscles and the tibia and lateral mallelus bones of the lower leg. The gaiter, designated by the letter C in FIGS. 1 and 2, is fabricated in the preferred embodiment with two sections of nylon material which may be stretchable, designated by the letters D and E in FIGS. 1 and 2, and a section of a synthetic nylon material with stretch qualities, designated by the letter F.

The details of the method of manufacture of the protective gaiter will be more thoroughly discussed in following paragraphs. The stretch material which is preferably utilized for the gaiter provides the gaiter with its form-fitting and support qualities and holds the protective pad B in position relative to the gaiter and to the leg of the wearer. The three sections of material D, E and F are sewn together along the opposing seams designated H, which are adjacent the longitudinal edges of the protective pad B, and are also sewn together adjacent the lower edge of the material sections D and E, as shown by the seam designated by the letter G in FIG. 1. The protective pad B is inserted between the material sections D and E, which forms a pocket for the pad B, holding it in place when the gaiter is in use.

The gaiter is fitted with an elastic strap designated by the letter J in FIG. 1 that forms the stirrup of the protective gaiter and thereby assists in holding the gaiter and the protective pad in position, when the protective gaiter is on the leg of the wearer. The elastic stirrup J is serge stitched at the point where it is secured to the material sections D and E, at the seam designated K in FIG. 1. An elastic cuff or collar is positioned adjacent and secured to the upper edge of the material sections D, E and F, the collar being designated by the letter L in FIG. 1. The collar is stitched along the seam designated M in FIG. 1 to the upper edge of the material sections D, E, and F, with the upper edges of sections D and E being joined together along their length, thereby resulting in a completely closed seam around the protective pad B.

Although the protective gaiter is primarily designed to be used in playing the game of soccer, it can be used with equal facility in virtually any contact sport, for instance, football, rugby, basketball, and baseball. Additionally, although the gaiter will find its primary use on the legs of a wearer, it can be used as a protective device for the arm as well.

Figure 3:
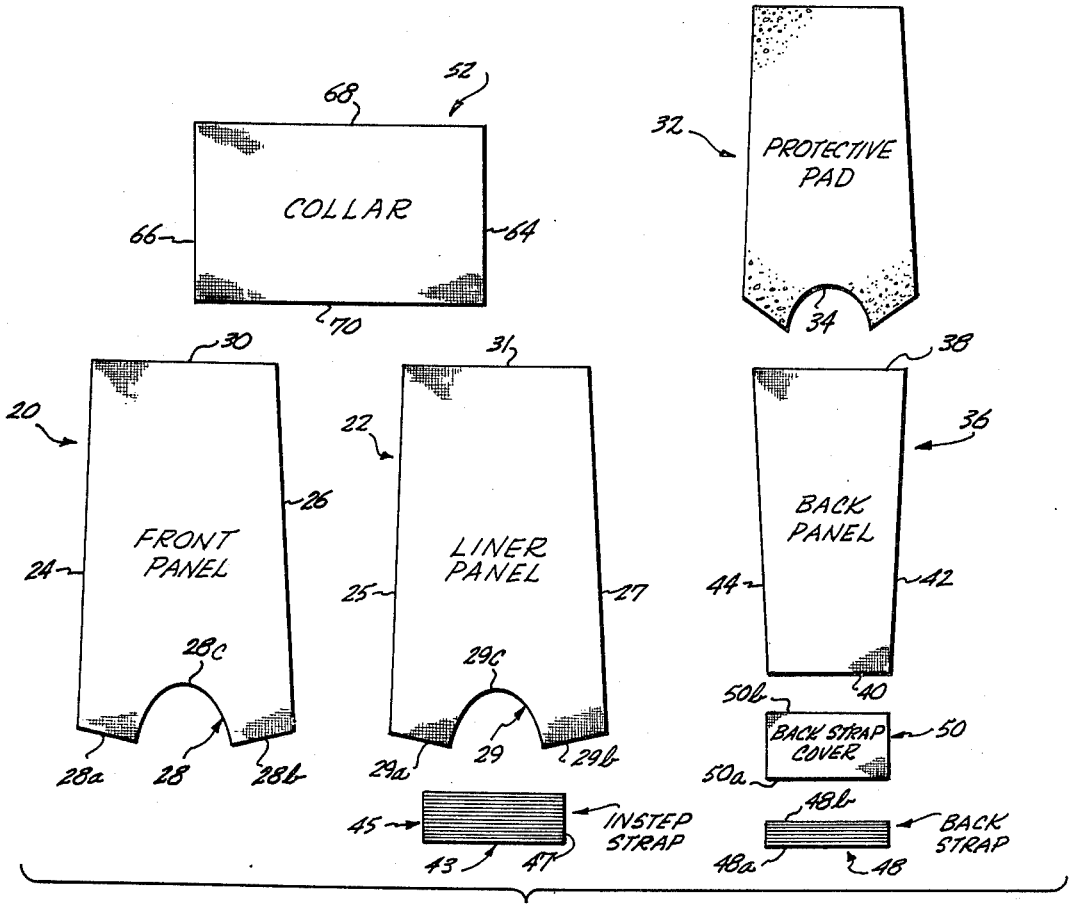
FIG. 3 is a plan view showing the various parts of the protective gaiter.

FIG. 3 shows relatively-sized patterns for the various parts of the protective gaiter. Front panel 20 and liner panel 22 are identical and are preferably made from a stretchable nylon or other washable synthetic fabric. Front panel 20 and liner panel 22, as well as other nylon parts of the protective gaiter are preferably cut so that the maximum stretch is in the transverse direction.

Front panel 20 and liner panel 22 are preferably quadrilateral in outline, each panel having three substantially straight edges and a fourth edge which has a particular shape discussed more fully in following paragraphs. Front panel 20 has longitudinal edges 24 and 26, lower edge 28, and upper edge 30, longitudinal edges 24 and 26 converging slightly toward each other as they extend from lower edge 28 to upper edge 30. Lower edge 28 comprises three successive portions between longitudinal edges 24 and 26, opposite straight end portions 28*a* and 28*b*, and intermediate end portion 28*c*. Opposite straight end portions 28*a* and 28*b* are both straight and each extends inwardly from the respective longitudinal edges 24 and 26 approximately one-third of the straight-line distance between longitudinal edges 24 and 26.

Opposite straight end portions also extend somewhat downwardly relative to a straight line connecting the respective intersections of said opposite straight end portions with longitudinal edges 24 and 26, and preferably, although not necessarily, the angle between longitudinal edges 24 and 26 and their associated end portions 28*a* and 28*b* is between 100° and 120°, for appearance, fit and economy of material. Intermediate end portion 28*c*, is concave in outline, and in the preferred embodiment takes the form of a half-ellipse. The shape of the lower edge 28 of front panel 20 and liner panel 22 permits the protective gaiter to cover the upper part of the wearer's foot, as well as his shins. The exact shape of the intermediate end portion 28*c*, the angular relationship between longitudinal edges 24, 26 and opposite straight end portions 28*a*, 28*b* and the dimensional relationship between portions 28*a*, 28*b*, 28*c* of lower edge 28 all may be varied, so long as adequate protection to the upper foot, ankles and shins of a wearer is accomplished. Furthermore, although the dimensions of the front and liner panels 20 and 22 may also be varied, they must be long enough to extend from substantially the wearer's knee to his instep, and wide enough to produce a gaiter which will surround the wearer'leg. As an example, front and liner panels for medium-sized gaiters will have longitudinal edges approximately 13 inches and an upper edge approximately 6 inches long. The topmost extent of the intermediate end portions will be approximately 2 inches from the lower edges.

As mentioned above, liner panel 22 is substantially identical in size and shape to front panel 20. Referring to FIG. 3, liner panel 22 has longitudinal edges 25 and 27, lower edge 29, and upper edge 31, with lower edge 29 comprised of straight end portions 29*a* and 29*b* and concavely shaped intermediate end portion 29*c*.

Protective pad 32 is similar in shape to front panel 20 and liner panel 22, as protective pad 32 is, in the finished article, positioned in a pocket formed between front panel 20 and liner panel 22. Thus, protective pad 32 has a lower edge 34 which is similar in outline to lower edge 28 of the front panel 20 and lower edge 29 of liner panel 22. The protective pad 32 will, however, have slightly smaller dimensions than front panel 20 and liner panel 22, so that it may be easily inserted therebetween when the corresponding longitudinal and lower edges of the front panel 20 and liner panel 22 are secured together. For a medium sized gaiter, the protective pad will have longitudinal edges approximately 10 inches long and an upper edge approximately 5 inches long.

In the finished article, front panel 20 and liner panel 22 form a pocket by virtue of having their respective longitudinal and lower edges secured together. Back panel 36, in the finished article, extends between and is secured to the respective longitudinal edges of the pocket formed by front panel 20 and liner panel 22, as will be hereinafter clarified. Back panel 36 is preferably trapezoidal in outline, and has a top edge 38 which is slightly longer than its lower edge 40, with top edge 38 preferably being somewhat shorter than top edges 30, 31 of front and liner panels 20, 22. Longitudinal edges 42 and 44 of back panel 36 thus converge slightly toward each other from top edge 38 to lower edge 40. Back panel 36 is shorter in length than front panel 20 and liner panel 22 in the preferred embodiment, such that when top edge 38 of back panel 36 is aligned with the top edges 30, 31 of front and liner panels, 20 and 22, respectively, lower edge 40 of back panel 36 is in the vicinity of the topmost extent of intermediate end portions 28*c* and 29*c* and preferably at a point approximately ½ to 1 inch above the topmost extent of intermediate end portions 28*c* and 29*c* of front and liner panels 20 and 22. For a medium sized gaiter, the back panel will have longitudinal edges approximately 11 inches long an upper edge approximately 4½ inches long and a lower edge approximately 4 inches long.

Instep strap 43 has a rectangular outline and is made from elastic material. Opposing end edges 45 and 47 of instep strap 43 are slightly less wide than the length of opposing straight end portions 28*a*, 28*b*, and 29*a*, 29*b*. In the finished article, end edge 45 of instep strap 43 is secured between straight end portions 28*a* and 29*a* of front and liner panels 20 and 22, while end edge 47 is secured between straight end portions 28*b* and 29*b* of front and liner panels 20 and 22. Instep strap 43 is sufficiently long to permit the athlete's foot to be positioned between the strap 43 and the lower edge of the gaiter in the finished article. For a medium sized gaiter, the instep strap will be approximately 5½ inches by 1½ inches.

Back strap 48 and back strap cover 50 are also both rectangular in outline, with back strap cover 50 being slightly greater than twice as wide as back strap 48, both back strap 48 and back strap cover 50 being substantially identical in length to the length of lower edge 40 of back panel 36. Back strap 48 may vary in width, but will typically be about ½ inch. Back strap 48 is made from an elastic material while cover 50 is preferably made from the same material as is back panel 36, front panel 20 and liner panel 22.

The collar 52 is also rectangular in outline, and is preferably made from a stretchable nylon fabric similar to that of the front, liner and back panels. Collar 52 has a length sufficient to completely encircle the wearer's leg near his knee, and a width sufficient to help hold the gaiter in place in the vicinity of the wearer's knee. For a medium sized gaiter, the collar will be approximately 9 inches by 5 inches. Since the collar is preferably doubled over longitudinally before it is secured to the top edges of the front panel 20, liner panel 22 and back panel 36, the width of the collar in the finished article will thus be approximately one-half of its original width.

Figure 4A:
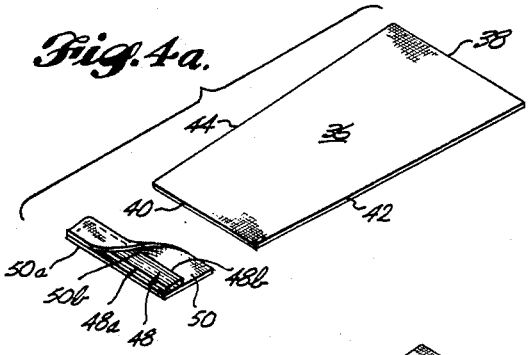
FIG. 4*a* is an isometric view of the first step in one method of securing an elastic back strap to the back panel, showing the covering of the elastic back strap by a back strap cover.
Figure 4B:
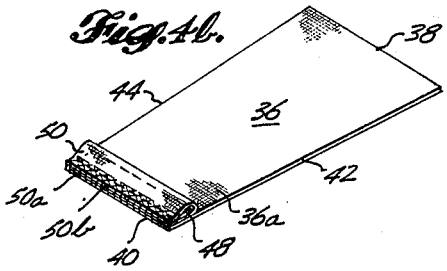
FIG. 4*b* is an isometric view showing the second step in the method of FIG. 4*a*. in which the combination of back strap and cover is secured along one edge to the lower edge of the back panel.

Referring now to FIGS. 4*a*–4*d*, a first method for securing back strap 48 to back panel 36 is shown. The first method includes the use of back strap cover 50. In the first step, shown in FIG. 4*a*, back strap 48 is positioned on and aligned lengthwise with back strap cover 50, with longitudinal edge 48*a* of back strap 48 being positioned parallel with, but slightly inward of, longitudinal edge 50*a* of cover 50. The surface of cover 50 desired to be exposed is facing downward, opposite from the surface on which back strap 48 is placed. Longitudinal edge 50*b* of cover 50 is then rotated about longitudinal edge 48b of back strap until longitudinal edges 50a and 50b of cover 50 are aligned, terminating in a common plane, thereby enclosing back strap 48 along its length. The combination of cover 50 and back strap 48 is then positioned on the surface 36a of back panel 36 which is to be exposed as shown in FIG. 4b such that longitudinal edges 50a and 50b of cover 50 terminate in a common plane with lower edge 40 of back panel 36, with the combination of back strap 48 and cover 50 extending inwardly of back panel 36 from its lower edge 40 thereof on surface 36a. In this position, lower edge 40 of back panel 36 and longitudinal edges 50a and 50b of cover 50 are secured together therealong. In the preferred embodiment a particular sewing stitch known in the art as serging is used for added strength, although other stitching may conveniently be used.

Figure 4C:
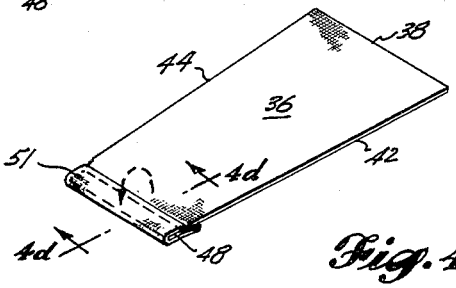
FIG. 4*c* is an isometric view showing the third step in the method of FIGS. 4*a* and 4*b*, in which the combination of the back strap and cover, now secured to the back panel, is rotated 180° about the one secured edge.
Figure 4D:
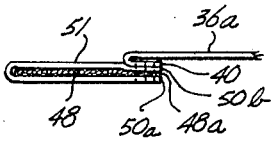
FIG. 4*d* is a cross-sectional view of the article of FIG. 4*c*, taken along lines 4*d*—4*f* in FIG. 4*c*.

Referring to FIGS. 4c and 4d, the combination of cover 50 and back strap 48, now serged to the back panel 36, is then rotated 180° about secured edges 40, 50a and 50b, such that portion 51 of cover 50 originally lying adjacent surface 36a of back panel 36 during the step of sewing shown in FIG. 4b is now effectively an extension of the length of back panel 36, and parallel therewith.

Referring now to FIGS. 5a and 5b, a second method of securing back strap 48 to back panel 36 is illustrated. This second method eliminates cover 50 although the back panel 36 of FIGS. 4a–4d is extended in length substantially corresponding to the width of cover 50. Referring to FIGS. 5a and 5b, a portion 54a of extended back panel 54 is first folded back upon extended back panel 54 about transverse line 56, until portion 54a lies adjacent the remainder of extended back panel 54. In this position, a portion 55 of lower surface 56 lying between lower edge 58 and edge line 56 of extended back panel 54 is now exposed. Back strap 48 is then positiond on portion 55 in such a fashion that longitudinal edge 48a of back strap 48 is positioned parallel with, and slightly inwardly of, extended back panel transverse line 56. The lower edge 58 of extended back panel 54 is then rotated about the other longitudinal edge 48b of back strap 48 until lower edge 58 terminates at the same plane with and comes into contact with, transverse line 56. In this position portion 54a encloses back strap 48 along its length. Lower edge 58 of extended back panel 54 is then secured to transverse line 56 by means of serging. The result provided by the method of FIGS. 5a and 5b is very similar to that of the method of FIGS. 4a–4d, except that, in FIGS. 5a and 5b, extended back panel 54 combines the back panel 36 and cover 50 of FIGS. 4a–4d.

FIG. 6 shows a variation of the method of FIGS. 4a–4c. Instead of using back straps and covers precut to the particlar length required for use with a single back panel, a continuous strip 60 of back strap material and a continuous strip 61 of cover material is provided, with back panels 36 being successively positioned along and sewn to the combination of continuous strips 60 and 61. The combination of continuous strips 60 and 61 is then severed between adjacent back panels 36 after it has been secured to the back panels 36.

FIGS. 7a–7g illustrate the steps of the method of the present invention in securing together front panel 20, liner panel 22, instep strap 42 and back panel combination 62, which is defined as the end product of the methods illustrated in FIGS. 4a–4c, 5a–5b or 6. FIGS. 7h and 7i illustrate the step of positioning the protective pad 32 in the article produced by the method of FIGS. 7a–7g.

Referring to FIG. 7a, front panel 20 and liner panel 22 are initially positioned so as to be in vertical alignment with each other, while back panel combination 62 is positioned intermediate thereof and positioned such that its longitudinal edge 42 terminates in a common vertical plane with longitudinal edge 26 of front panel 20 and longitudinal edge 27 of liner panel 22. Back panel combination 62 is also positioned such that it terminates in the same vertical plane as upper edge 30 of front panel 20 and upper edge 31 of liner panel 22. In this initial relationship, with back panel combination 62 interposed between, and contacting front panel 20 and liner panel 22, longitudinal edges 26, 27 and 42 of front panel 20, liner panel 22 and back panel combination 62, respectively, are secured together along a line 63, as shown in FIG. 7b. In the preferred embodiment, the securing is accomplished by sewing, preferably serging, for purposes of maximum strength.

Referring now to FIG. 7c, end edge 45 of instep strap 43 is initially positioned between, and aligned with, straight end portion 28b of front panel 20, and straight end portion 29b of liner panel 22. Instep strap 43 is initially oriented such that it extends inward of front panel 20 and liner panel 22 from its position between straight end portions 28b and 29b. Referring now to FIG. 7d, the end portions 28b and 29b of front panel 20 and liner panel 22 and interposed end edge 45 of instep strap 43 are then secured together, preferably by a serge stitch, along line 65.

Instep strap 43 is then stretched in the direction of its length and positioned such that end edge 47 of instep strap 43 lies between and terminates in a common plane with straight end portion 28a of front panel 20, and straight end portion 29b of liner panel 22. In this relative position of front panel 20, liner panel 22 and instep strap 42, intermediate end portions 28c of front panel 20 and 29c of liner panel 22 will also be aligned with each other, and are then secured together, again preferably by a serge stich, along line 67, as shown in FIG. 7d. Instep strap 43 is not secured to front panel 20 or liner panel 22 along line 67. Next, as shown in FIG. 7d, straight end portion 28a of front panel 20, straight end portion 29a of liner panel 22, and interposed end edge 47 of instep strap 42 are secured together along line 69, again by sewing, and preferably by serging. Instep strap 43 is at this point securely attached at its respective end edges 45, 47 to front panel 20 and liner panel 22, thereby defining a stirrup for the gaiter.

Referring now to FIG. 7e, back panel combination 62 is next stretched laterally such that its longitudinal edge 44 is aligned with longitudinal edges 24 of front panel 20 and 25 of liner panel 22. In this position, they are secured together along line 71, preferbly by serging. At this point the article of FIG. 7e is turned inside out by pulling the instep strap 43 back through the gaiter between the front panel 20 and the back panel combination 62, and out beyond the upper edges 30 and 31 of front and liner panels 20 and 22, thereby reversing the relative vertical positions of back panel combination 62, front panel 20 and liner panel 22. As shown in FIG. 7g, following the step of pulling the gaiter inside out, front panel 20 and liner panel 22 are now adjacent each other, and back panel combination 62 is positioned adjacent liner panel 22. In use, the wearer inserts his leg between liner panel 22 and back panel combination 62, with instep strap 43 being positioned around his foot.

FIGS. 7*h* and 7*i* illustrate the positioning of protective pad 32 into a gaiter pocket 73 which is defined by the lines of sewing 63, 65, 67, 69 and 71 (not shown in FIGS. 7*h* and 7*i*). The protective pad 32 is inserted into pocket 73 between front panel 20 and liner panel 22 until its own outline substantially mates with the outline of the pocket 73. FIG. 7*i* shows the protective pad 32 in place in pocket 73.

FIGS. 8*a* and 8*b* illustrate a first method for making the collar of the gaiter. Referring to FIG. 8*a,* collar 52 is first folded transversely such that lateral edges 64 and 66 thereof lie adjacent and terminate in a common vertical plane. In this position lateral edges 64 and 66 of collar 52 are secured together, along line 75, preferably by serging. The collar 52 is next expanded outwardly to form a cylinder, with each longitudinal edge 68 and 70 of collar 52 thereby defining substantially a circle. Longitudinal edge 68 is then moved outwardly and downwardly until it lies adjacent to and terminates in a common plane with longitudinal edge 70. In this orientation, line 75 is hidden, as shown in FIG. 8*b.*

FIGS. 9*a* through 9*f* illustrate another method for making the collar. Referring to FIG. 9*a,* the lateral edges 64 and 66 of collar 52 are again initially positioned so that they lie adjacent one another and terminate in a common plane. However, instead of serging lateral edges 64, 66 at this point as was done in the method of FIGS. 8*a* and 8*b,* the transversely folded collar of FIG. 9*a* is folded again about a longitudinal midpoint, such that oppositely disposed end points 72 and 74 of the lateral edges 64, 66 of FIG. 9*a* lie adjacent one another. In this position, the now twice folded collar is serged adjacent the lateral edges 64, 66 along line 77. Longitudinal edge 68, which is the topmost longitudinal edge, and which has opposite ends secured together at end point 74, is then pulled up slightly, as shown in FIG. 9*c,* and opened so that it defines a somewhat distorted ellipse. Referring to FIGS. 9*d* and 9*e,* longitudinal edge 68 is then folded over the remainder of the collar 52, until longitudinal edge 68 encircles longitudinal edge 70, and terminates in a common plane therewith, resulting in line 77 being rotated out of view. The end result of the steps of FIGS. 9*d* and 9*e* is the collar illustrated in FIG. 9*f.*

Figure 10:
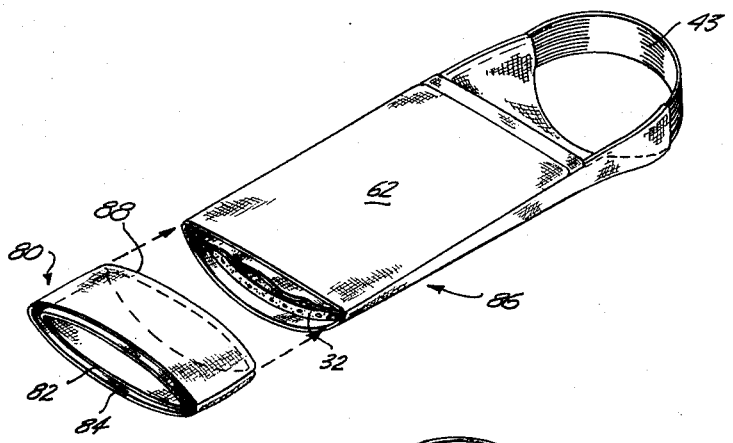
FIG. 10 is an isometric view of the step of the method of manufacturing a protective gaiter of attaching the collar to the remainder of the protective gaiter.
Figure 11:
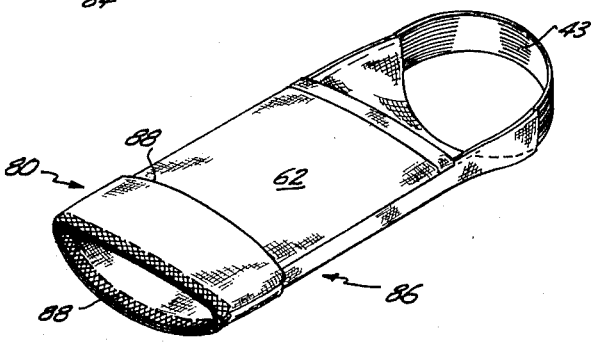
FIG. 11 is an isometric view showing the step of sewing the longitudinal edges of the collar to the upper edges of the front panel, back panel and liner panel.
Figure 12:
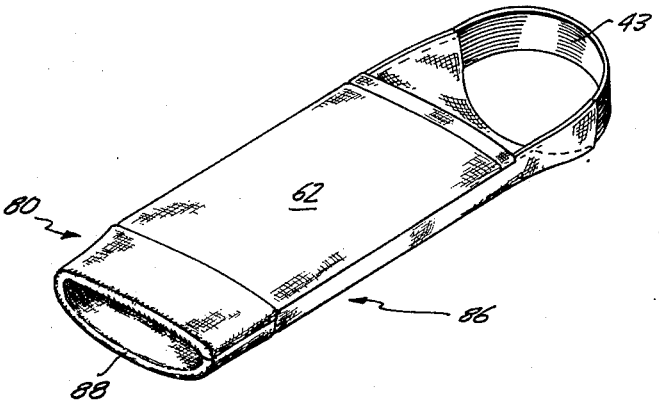
FIG. 12 is an isometric view showing the completed protective gaiter.

The folded collar, shown in FIGS. 8*b* and 9*f,* is now ready for attachment to the gaiter of FIG. 7*k* to complete the manufacture of the article. Referring to FIG. 10, the folded collar 80 is oriented so that it may be slipped over and around the body of the gaiter 86, beginning at the upper edges 30, 31 and 38, respectively, of front panel 20, liner panel 22 and back panel combination 62. Folded edge 88 of collar 80 is initially presented adjacent upper edges 30, 31 and 38 and it is then fitted over the gaiter 86 and then slid down a portion of the length of the gaiter 86 such that longitudinal edges 82 and 84 of collar 80 terminate in the same plane with upper edge 38 of back panel combination 62, upper edge 30 of front panel 20 and upper edge 31 of liner panel 22. In this position, longitudinal edges 82 and 84 of collar 80 are serged along line 81 to back panel combination 62 and the combined upper edges 30 and 31 of the front and liner panels, respectively, thereby defining an opening between back panel combination 62 and liner panel 22, as shown in FIG. 11. Lastly, folded edge 88 of folded collar 80 is rotated approximately 180° about line 81, thereby extending the length of the gaiter. In use, the collar helps to maintain the gaiter in place on a wearer's leg. FIG. 12 shows the completed protective gaiter.

It should be recognized that various modifications and changes can be made to the protective gaiter and to its method of manufacture described herein without departing from the spirit of the invention. For instance, the various dimensions of the protective gaiter may be modified to suit individual circumstances, and the various outlines of the constituent parts of the device as well as some of the materials suggested may be altered within the scope of the invention.

What is claimed is:

1. A method of manufacturing a protective gaiter, wherein said gaiter includes first and second substantially identical fabric sections, each of said fabric sections having, in outline, upper and lower edges, and two longitudinal edges extending therebetween, the lower edge of said first and second fabric sections having first and second straight edge portions and an intermediate edge portion, said intermediate edge portion being concavely shaped, said gaiter further including a third fabric section having in outline, upper and lower edges, and two longitudinal edges extending therebetween, an energy-absorbing pad, and an elastic strap having two ends, the method comprising the steps of:

aligning said first, second and third fabric sections such that their respective upper edges are adjacent each other and terminate in a common plane, and such that one of their respective longitudinal edges lie adjacent, each other and terminate in a common plane, thereby defining a first gaiter longitudinal edge;

securing together said first, second and third fabric sections along a line adjacent said first gaiter longitudinal edge;

securing together said first and second fabric sections along a line adjacent the lower edges thereof, including the step of securing one end of said elastic strip between adjacent first straight edge portions of said first and second fabric sections, and securing the other end of said elastic strip between adjacent second straight edge portions of said first and second fabric sections;

aligning the other longitudinal edge of each of said first, second and third fabric sections, thereby defining a second gaiter longitudinal edge;

securing together said first, second and third fabric sections along a line adjacent said second gaiter longitudinal edge, said first and second fabric sections, thereby defining a pocket;

inserting said protective pad into said pocket; and securing together said first and second fabric sections along a line adjacent the upper edges thereof, thereby defining a partial gaiter upper edge and completely enclosing said protective pad in said pocket.

2. The method of claim 1, wherein the steps of securing are sewing steps.

3. The method of claim 1, wherein the step of securing along a line adjacent the lower edge of said first and second fabric sections includes the steps of securing one end of said elastic strip between first straight edge portions of the lower edge of said first and second fabric sections, stretching said elastic strip such that the other end thereof lies between the second straight edge portions of said lower edge of said first and second fabric sections, defining thereby a second straight edge combination, and securing together said intermediate edge portions of said first and second fabric sections and then said second straight edge portion combination.

4. The method of claim 1, wherein the step of aligning includes the step of positioning said third fabric section between said first and second fabric sections.

5. The method of claim 4, including the step of pulling a sewn combination of first, second and third fabric sections and said elastic strip inside out such that said first and second fabric sections lie adjacent each other prior to the step of inserting said protective pad into said pocket.

6. The method of claim 5, wherein the gaiter includes a fourth fabric section which is substantially rectangular in outline, having two end edges and two longitudinal edges extending therebetween, and wherein the method includes the further steps of securing said two end edges together to form a continuous fourth fabric section strip, folding one of said longitudinal edges over the remainder of the fourth fabric section strip until said two longitudinal edges thereof are presented adjacent each other, and, securing said two longitudinal edges to said partial gaiter upper edge and the upper edge of said third fabric section.

7. The method of claim 5, wherein said gaiter includes a fourth fabric section substantially rectangular in outline having two end edges and two longitudinal edges, and wherein the method includes the further steps of folding said fourth fabric section transversely such that said two end edges lie adjacent each other, defining once-folded, fourth fabric section, folding said once-folded, fourth fabric section in half longitudinally, thereby defining a twice-folded, fourth fabric section, securing said end edges together, opening one of said longitudinal edges such that it forms a loop, folding said one longitudinal edge about the remainder of said twice-folded, fourth fabric section such that it is turned inside out, thereby removing said sewn end edges from view and presenting said one longitudinal edge adjacent to and bounding said other longitudinal edge, and, sewing said two longitudinal edges to said partial gaiter upper edge and to the upper edge of said third fabric section.

* * * * *